United States Patent [19]

Lusby

[11] 4,080,870

[45] Mar. 28, 1978

[54] MULTIPLE POSITION FLUID CONDUCTOR APPARATUS

[75] Inventor: Elmer Gene Lusby, Littleton, Colo.

[73] Assignee: Stearns Roger Corporation, Denver, Colo.

[21] Appl. No.: 757,843

[22] Filed: Jan. 10, 1977

[51] Int. Cl.[2] ..... F15B 13/06; F15B 15/08

[52] U.S. Cl. ..... 91/414; 91/189 A; 92/111; 92/112

[58] Field of Search ..... 91/189 R, 189 A, 414; 92/111, 112

[56] References Cited

U.S. PATENT DOCUMENTS

| | | | |
|---|---|---|---|
| 2,778,193 | 1/1957 | Stockett | 91/414 X |
| 3,207,044 | 9/1965 | Hall | 91/414 |
| 3,990,349 | 11/1976 | Valantin | 91/413 X |

*Primary Examiner*—Alan Cohan
*Assistant Examiner*—Gerald A. Michalsky
*Attorney, Agent, or Firm*—Sheridan, Ross, Fields & McIntosh

[57] ABSTRACT

Total apparatus includes extensible and retractable means for moving a load linearly between two or more spaced positions, the load having a fluid pressure operated motor, and means for delivering fluid from a pressure source to the motor at selected stages of extension. A cylinder having a head end and a shaft bearing end houses a piston rod and piston which are reciprocated by fluid pressure through a pair of actuation ports. A passage extends through the length of the piston rod and through the piston to a marginal wall. Fluid pressure power ports extending through the cylinder wall are spaced longitudinally at selected stations and the piston may be moved to any station, where its passage registers with the corresponding power port. Fluid from the pressure source may then be delivered through the piston and rod and by conduit means from the outer end of the rod to the motor on the load. There are no swivel joints or hoses in the fluid path to leak or deteriorate in use.

10 Claims, 5 Drawing Figures

MULTIPLE POSITION FLUID CONDUCTOR APPARATUS

BACKGROUND OF THE INVENTION

The invention lies in the field of actuators and variable length fluid supply means and is directed to improved means for delivering high pressure fluid to a motor mounted on a mechanism which is to be operated at various distances from a base to which it is extensibly connected. It is more particularly directed to such an arrangement in which a hydraulic actuator is used to position the movable mechanism with respect to the base and part of the actuator is used to provide a major portion of the fluid transmission line.

Many machines are in use at the present time in which a massive member of some kind is movably connected to a stationary base and is provided with a fluid motor which may be reciprocating or rotary for performing a specialized function and requires pressurized operating fluid of the order of several thousand pounds per square inch to produce the power necessary for its function. Such machines include large machine tools, cranes, mining machines and others.

In many such installations a servo motor is used which comprises a cylinder mounted on or anchored to a relatively stationary base, a piston slidably mounted in the cylinder for reciprocation by fluid pressure, and a piston rod connected at its inner end to the piston and at its outer end to the load to be moved. The pump or other source of pressurized fluid is usually mounted in fixed position on or adjacent to the base and rigid piping is used to connect the pump to the cylinder to prevent leaks or deterioration in the supply line. Since the fluid motor on the load must be shifted to positions at varying distances from the base it is necessary to provide extensible conduit means for carrying the fluid from the pump or the base to the fluid motor. The conventional conduit means for this purpose are lengths of pipe connected to each other and to the pump and motor by swivel joints, and rubber-like hoses.

Both of these schemes have various disadvantages which render them generally unsatisfactory. The distances involved often approach twenty feet. Two 10-foot pipes with their swivel joints must extend outward in some direction a distance of 10 feet. In many cases that much room is not available. Even when such room is available it is difficult to maintain such slumsy devices in alignment, and the swivel joints rapidly develop leaks. The pipes may be made shorter and more numerous with a corresponding increase in the number of swivel joints. However, such arrangement requires complicated yielding support means for the pipe segments and the joint leakage problem becomes greater.

Flexible hose lines pose similar problems. They must extend outward in some direction when the machine is retracted and they must be yieldably supported. At very high pressures they deteriorate in a relatively short time and are subject to delamination and abrasion damage. Leakage at the connections between hose ends and fittings is also a common problem.

SUMMARY OF THE INVENTION

The apparatus of the present invention overcomes the difficulties and disadvantages mentioned above and provides a simple and highly reliable construction which does not require any more clearance than the equipment with which it is used. Swivel joints and flexible connections are eliminated.

Generally stated, in its presently preferred form, the apparatus includes a cylinder having a head end and a shaft bearing end, a piston rod slidable in the bearing end of the cylinder and having a formation at its outer end for connection to a load to be moved, and a piston on the inner end of the rod and slidable in the cylinder. A pump or other source of pressurized fluid is provided and conduits are connected from the pump to a pair of actuation ports in the end portions of the cylinder. Valve means in the conduit lines regulate flow through the ports to move the piston to selected positions or stations corresponding to the desired working locations of the load which is connected to the outer end of the piston rod.

The piston rod has at least one longitudinal passage extending throughout the major portion of its length. Port means at the outer end connect to the passage and are open to the exterior. Other port means are connected to the inner end of the passage and extend to the peripheral wall of the piston. Power port means extend through the wall of the cylinder and are located at stations spaced along the length of the cylinder. The piston may be moved to any selected station and its port will be in registry with the corresponding power port in the cylinder wall. The outer end of the rod is fixedly connected to the load, and conduit means extend from the port means in the outer end of the rod to the fluid motor on the load. Since the distance is constant it is possible to use fixedly connected rigid piping for the conduit means.

The same or a second pump is used for supplying pressurized fluid through rigid piping, with appropriate valving, to the power ports. The valving is selected so that, with the piston at any selected station, fluid communication is open only between the pump and the power port at that station. Thus, a load may be moved to any desired location for use and pressurized fluid is supplied to its fluid motor through a complete system of rigid piping.

As compared with hose type conduitry used for the same purpose, the present construction provides higher flow capacity, higher pressure capability, and higher operating temperature capability, as well as freedom from leaks and greater durability. As compared with swivel jointed piping type conduitry, it requires no extra clearance and provides greater reliability and longer operating life.

BRIEF DESCRIPTION OF THE DRAWING

Various other advantages and features of novelty will become apparent as the description proceeds in conjunction with the accompanying drawings, in which.

DESCRIPTION OF PREFERRED EMBODIMENTS

Figure 1:
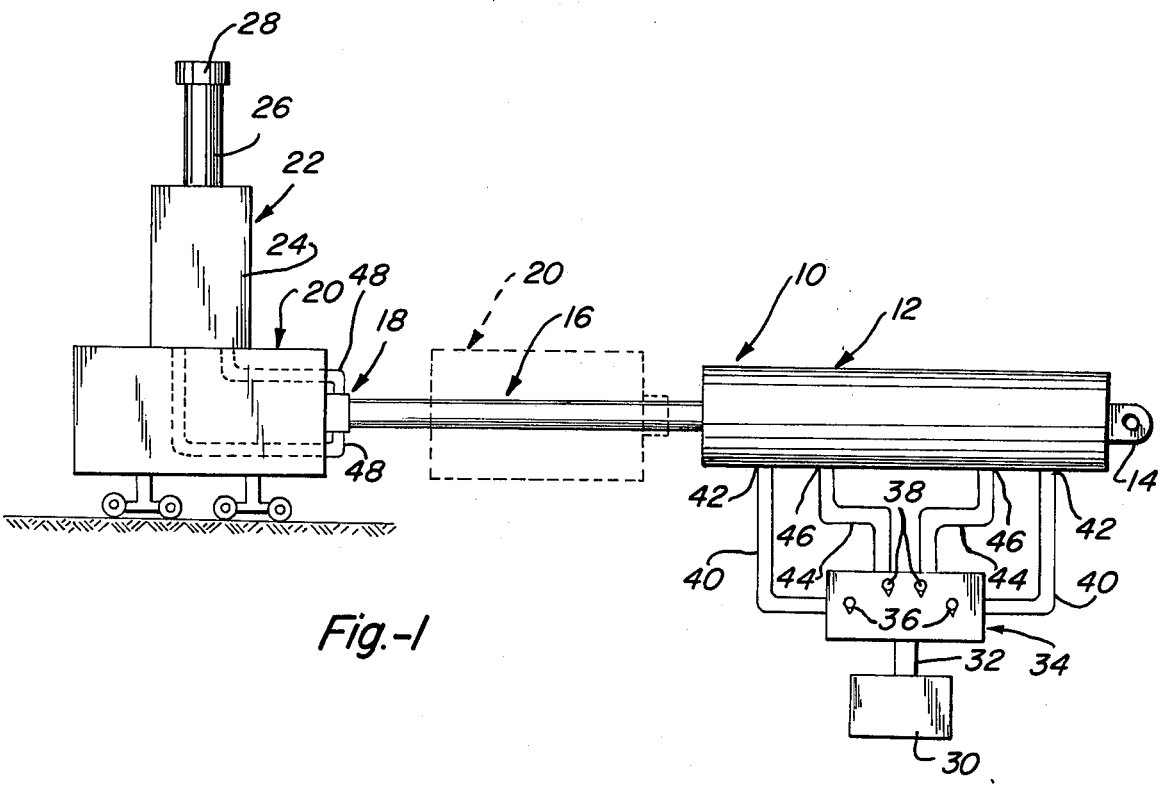
FIG. 1 is a schematic side elevational view of one form of apparatus in which the invention is incorporated.

The general arrangement of a construction which has a hydraulic actuator, a load moved by it, and a fluid motor carried by the load, and which incorporates the features of the invention is very schematically illustrated in FIG. 1, in which a hydraulic actuator 10 includes a cylinder 12 which may be mounted on or anchored to a relatively stationary base by any suitable means such as trunnion 14, and a piston rod 16 extensible and retractable in the cylinder in response to longitudinal movement of a piston, not shown, within the cylinder. The outer end 18 of the piston rod is connected to a load, such as carriage 20, which is extended and retracted by the rod. Mounted on the carriage is a fluid motor 22 which is shown as having a cylinder 24 and piston rod 26 carrying a tool 28 of any desired type. The motor might equally well be a rotary type. The device may be a machine tool or a mining machine or other device. While the invention has general utility it is particularly valuable when the load is massive and the fluid motor requires very high fluid pressures to produce the power needed for its functions.

A source 30 of highly pressurized fluid may include one or more pumps and reservoirs as needed. Conduitry 32 connects source 30 to a control console 34 provided with a plurality of valve controllers 36 and 38. Fluid conduits 40 connect the console to actuation ports 42 at the end portions of the cylinder, and controllers 36 are selectively operated to apply pressure to one or the other port 42 to move the piston to the desired position. A second pair of fluid conduits 44 connect the console to power ports 46 in the side wall of the cylinder inward of ports 42. Controllers 38 are selectively operated to supply pressurized fluid to one of the power ports 46. As explained in greater detail hereinafter, when carriage 20 is in either the solid line or the broken line position the piston will be in registry with one or the other of ports 46, and fluid from the source 30 flows through passage means in the piston, rod 16, and end 18, and then through conduits 48 to fluid motor 22.

Figure 2:
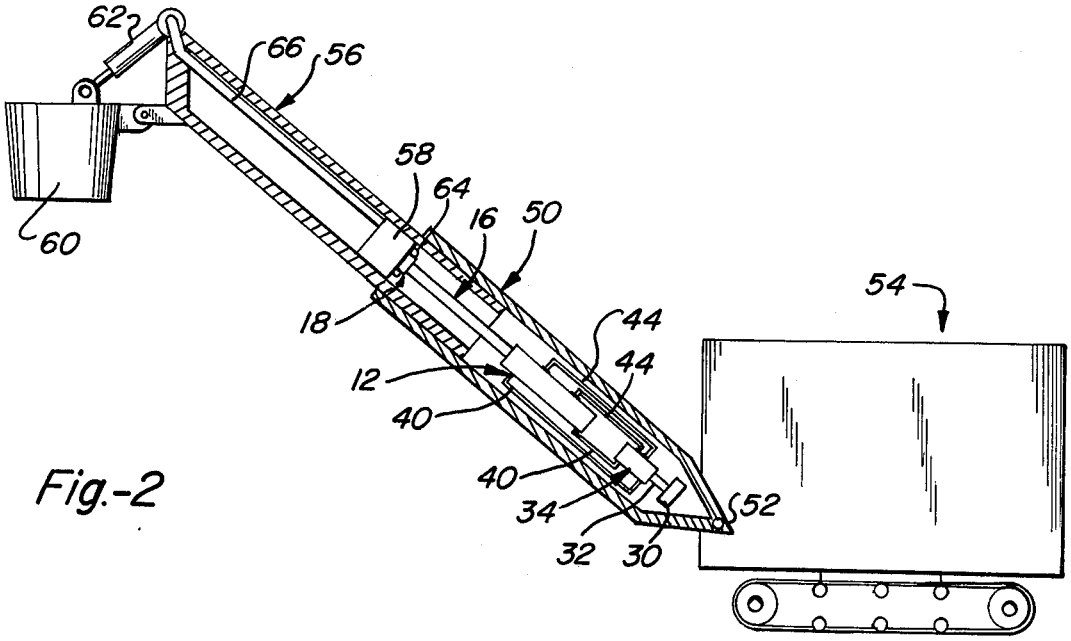
FIG. 2 is a similar view of another form of apparatus incorporating the invention.

Another construction which utilizes the same features is very schematically illustrated in FIG. 2. In this form, a primary boom 50 is connected by means of pivotal mounting 52 to a support 54. Additional supporting and controlling means for moving the primary boom or maintaining it in any desired position do not form a part of the invention and are not shown. Cylinder 12, controller 34, and source 30 are fixedly mounted on or in boom 50. A secondary or extension boom 56 is slidably mounted in boom 50 and is provided at an intermediate point with an anchorage 58 connected to end 18 of piston rod 16. Extension and retraction of the piston rod extends and retracts boom 56. The latter, at its upper end, pivotally carries a bucket or the like 60 together with a fluid motor 62 to control its attitude. As in the previous example, controllers 38 will be selectively operated to supply pressurized fluid to the power port 46 which is in registry with the piston, and the fluid will flow through the piston and rod to end 18. Conduit means 64 carries the fluid from the head to anchorage 58 and conduit means 66 carries the fluid from the anchorage to fluid motor 62.

Figure 3:
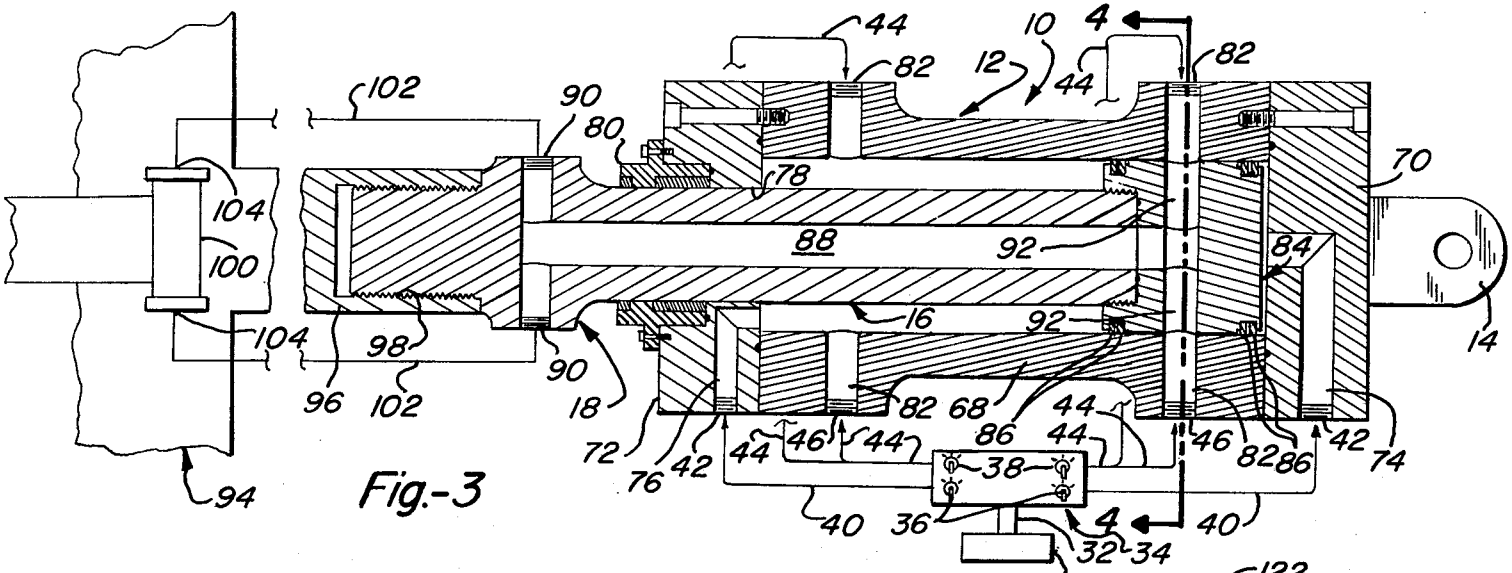
FIG. 3 is a longitudinal sectional view of a hydraulic actuator showing details of internal construction.

The preferred internal construction of hydraulic actuator 10 is shown in detail in FIG. 3. The cylinder 12 includes a barrel section 68 having a closure cap 70 at the head end and a bearing cap 72 at the shaft end. Cap 70 has a passage 74 leading from port 42 to the first end of the chamber of the cylinder and cap 72 has a similar passage 76 leading from port 42 to the second end of the chamber. Cap 72 is formed with a central axial bore 78 serving as a bearing for the shaft of piston rod 16 and is provided with a suitable packing gland 80. Barrel section 68 of the cylinder is formed with passages 82 through the wall to complete the ports 46. As shown, there are two ports located at selected stations longitudinally spaced along the length of the wall. For many intended uses only two stations are required but it is to be understood that ports may be provided at additional stations if called for by the circumstances of use. In the presently preferred form, ports 82 are provided in the cylinder wall at points diametrically opposite to ports 46, and conduits 44 are branched to extend to the opposed ports of each pair.

A piston 84 is threadedly connected to the inner end of piston rod 16 for joint longitudinal movement, and the piston is provided with suitable packing rings 86 engaging the cylinder wall. The valve controllers 36 may be selectively operated to admit pressurized fluid from source 30 through either of ports 42 to move the piston to either of the stations where ports 46 are located or to any other intermediate station where an additional power port is provided.

A preferably centrally located longitudinally extending passage 88 is formed in the piston rod and is flow connected at end 18 with one or more lateral ports 90 which open to the exterior of end 18. Flow path means are provided in the piston in the form of one or more radial passages 92 flow connected at the center of the piston to the inner end of passage 88 and extending to its marginal wall. Although more than two such passages may be provided, with a corresponding number of power parts, it is preferred to form them as one diametrically extending bore, the open ends of which are in registry with the diametrically opposed ports 46 at the selected station.

As an exemplary illustration of the utilization of the invention, a load 94 is provided with a connector member 96 which is threadedly engaged with the threaded formation 98 on the end 18 of the piston rod. A fluid motor 100 is mounted on the load and lengths of rigid piping 102 connect ports 90 on rod end 18 to ports 104 on motor 100. Since the distance between the motor and the rod end is constant, there is no need for swivel joints or lengths of flexible hose in the conduit means 102.

When controllers 36 have been operated to move the piston to either of the stations shown at the opposite ends of the piston travel or to any selected intermediate station, not shown, the appropriate one of controllers 38 is operated to permit flow of pressurized fluid to the port 46 which is in flow communicating registry with passage 92 in the piston. Fluid flows through passages 92 and 88, ports 90, conduits 102, and ports 104 to motor 100 to supply the requisite power. Reverse flow takes place along the same path in response to pump reversal or the like in the power source 30.

The size of the equipment is very large and the fluid pressures are very high, such as 3000 pounds per square inch or more. Consequently any unbalanced force arrangements may produce undesirable effects. It will be seen that with the arrangement as shown and described all pressure areas are balanced both laterally and longitudinally so that no net lateral or longitudinal force will be exerted, including the force of fluid acceleration.

Figure 5:
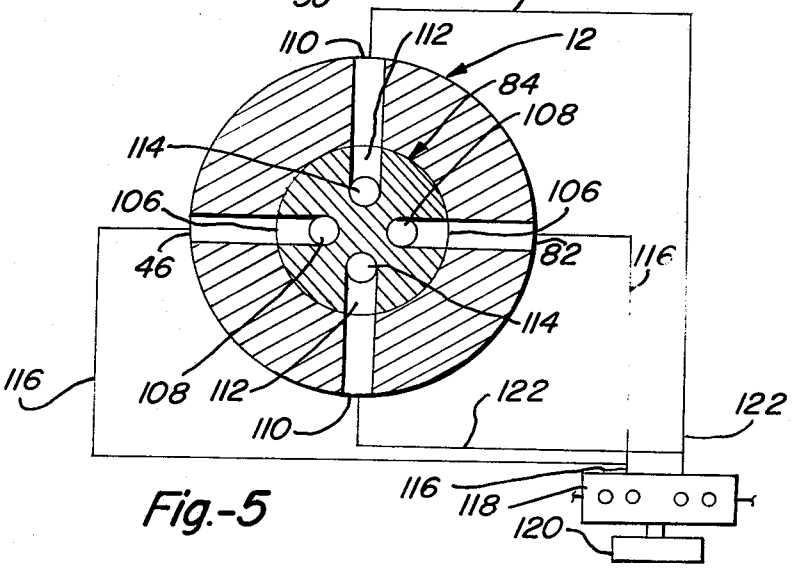
FIG. 5 is a view similar to FIG. 4 showing a modification.
Figure 4:
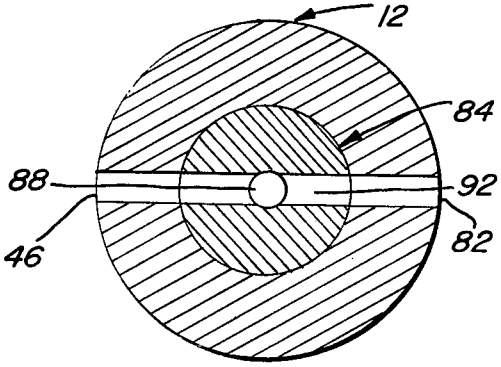
FIG. 4 is a sectional view taken on line 4—4 of FIG. 3.

As can be seen in FIG. 4, both ports 46 and 82 communicate through passage 92 with the single passage 88 in the piston rod and the pressure fluid flows alternately out and back through the same passage 88. In some cases it is desirable to apply pressure alternately to both sides of a servo motor to make it truly double acting, and of course it is necessary in rotary motor installations to have separate flow and return passages. To accomplish this and at the same time retain the pressure balancing features the construction may be modified as indicated in FIG. 5.

Here the opposite ports 46 and 82 communicate with passges 106 in the piston and longitudinal passages 108 in the piston rod. Similar ports 110 in the cylinder communicate with passages 112 in the piston and longitudinal passages 114 in the piston rod. Branched conduit 116 connects ports 46 and 82 through control console 118 to fluid pressure source 120, and branched conduit 122 connects ports 110 through control console 118 to fluid pressure source 120. In the case of a double acting servo motor the high pressure fluid may flow out through conduits 116 and passages 108, with the low pressure fluid returning through passages 114 and conduits 122, and the flow may be reversed when desired. In the case of a rotary motor the high pressure fluid may always flow out through conduits 116 and passages 108, with the low pressure fluid returning through passages 114 and conduits 122. In all of these modes it will be seen that all lateral and longitudinal fluid pressures are balanced out.

It will be apparent that the construction disclosed herein eliminates the need for unsatisfactory flexible hoses and swivel jointed piping but also provides a single apparatus which performs the dual functions of a hydraulic actuator and variable effective length conduit means for supplying high pressure fluid to a fluid motor at varying distances from the pressure fluid source.

What is claimed is:

1. Multiple position fluid conductor apparatus comprising:

a cylinder having a first substantially closed head end provided with an actuation port for the flow of pressurized fluid and a second shaft bearing end formed with a central axial bore for slidably receiving a piston rod and provided with an actuation port for the flow of pressurized fluid;

a piston rod axially slidably mounted in the bore for reciprocation and provided with a formation at its outer end for connection to a load;

a piston connected to the inner end of the piston rod and slidable in the cylinder;

means forming at least one longitudinal pressure fluid flow passage in the rod extending throughout the major portion of its length and terminating in port means open to the exterior of the rod adjacent to its outer end;

means forming a fluid flow path in the piston between the inner end of the passage in the rod and the peripheral wall of the piston between its pressure faces;

and a plurality of power ports for the flow of pressurized fluid extending through the wall of the cylinder and located at longitudinally spaced stations;

the piston being movable to any selected one of the stations to place its fluid flow path in flow communication registry with a power port located at that station.

2. Apparatus as claimed in claim 1; in which the piston rod is formed with a central axial fluid flow passage, and the fluid flow path means in the piston comprises at least one generally radially directed passage extending from the central passage in the rod to the peripheral wall of the piston.

3. Apparatus as claimed in claim 2; in which the fluid flow path means in the piston comprises a plurality of bores extending generally radially outward from the center of the piston with their inner ends being in flow communication with the passage in the piston rod;

and a plurality of power ports equal in number to the number of radial bores in the piston are provided in the cylinder wall at each station, and are located to be in registry with the outer ends of the piston bores when the piston is located at a selected station.

4. Apparatus as claimed in claim 2; in which the fluid flow path means in the piston comprises a bore extending diametrically across the piston, the central portion being in flow communication with the passage in the piston rod;

and diametrically opposed power ports are provided in the cylinder wall at each station located to be in registry with opposite ends of the piston bore when the piston is at a selected station.

5. Apparatus as claimed in claim 1; in which the port means adjacent to the outer end of the piston rod comprises a generally radially directed passage extending from the central passage in the piston rod to a side wall of the rod.

6. Apparatus as claimed in claim 1; in which the port means adjacent to the outer end of the piston rod comprises a diametrically directed passge extending across the rod and open at both ends, the central portion being in flow communication with the outer end of the longitudinal passage in the rod.

7. Apparatus as claimed in claim 1; in which the piston rod is provided with a plurality of discrete longitudinal fluid flow passages;

the port means adjacent to the outer end of the rod comprises a plurality of ports, each connected to one flow passage;

and the flow path means in the piston comprises a plurality of generally radial bores, each connected to one flow passage.

8. Apparatus as claimed in claim 1; in which a source of pressurized fluid is provided;

fluid flow conduit means are connected between the source and the actuation ports;

and control means are interposed in the conduit means to regulate the flow of pressurized fluid through the actuation ports for moving the piston from one station to another.

9. Apparatus as claimed in claim 1; in which a source of pressurized fluid is provided;

fluid flow conduit means are connected between the source and the power ports;

and control means are interposed in the conduit means to regulate the flow of pressurized fluid through selected power ports at selected stations;

a load is connected to the outer end of the piston rod to be moved in response to the longitudinal movement of the rod;

a fluid pressure operated device is mounted on the load;

and fluid flow conduit means are connected between the device and the port means at the outer end of the rod to transmit pressurized fluid from the source through the piston and rod to the device with the piston at any selected station.

10. Apparatus as claimed in claim 9; in which the distance between the device and the port means at the outer end of the rod remains constant throughout the range of extension and retraction of the rod.

* * * * *